United States Patent [19]

Paganoni

[11] 4,186,073

[45] Jan. 29, 1980

[54] PACKAGE FOR SEWING MACHINE NEEDLES OR THE LIKE

[75] Inventor: Cesare Paganoni, Vaals, Netherlands

[73] Assignee: Nederlandse Naaldenfabriek Muva B.V., Vaals, Netherlands

[21] Appl. No.: 955,459

[22] Filed: Oct. 27, 1978

[30] Foreign Application Priority Data

Mar. 23, 1978 [DE] Fed. Rep. of Germany ... 7808823[U]

[51] Int. Cl.[2] ..... B65D 85/24

[52] U.S. Cl. ..... 206/380

[58] Field of Search ..... 206/380, 214, 337, 443, 206/477, 480

[56] References Cited

U.S. PATENT DOCUMENTS

| | | | |
|---|---|---|---|
| 1,172,856 | 2/1916 | Williams | 206/380 |
| 2,817,434 | 12/1957 | Schmetz | 206/380 |
| 3,384,220 | 5/1968 | Linstead | 206/380 |
| 3,452,859 | 7/1969 | Hofmann | 206/380 |
| 3,647,057 | 3/1972 | Ashmead | 206/380 |
| 3,768,635 | 10/1973 | Eggert | 206/380 |
| 4,116,333 | 9/1978 | Ranel | 206/380 |

FOREIGN PATENT DOCUMENTS

| | | | |
|---|---|---|---|
| 558845 | 7/1957 | Belgium | 206/380 |
| 1133307 | 11/1968 | United Kingdom | 206/380 |

*Primary Examiner*—Herbert F. Ross
*Attorney, Agent, or Firm*—Martin A. Farber

[57] ABSTRACT

A package for sewing machine needles or the like, comprising a plate provided with needle reception pockets arranged in the form of rows adjacent to one another, the plate being made out of a flexible or elastic material. The reception pockets, corresponding in their length approximately to that of the needles and being closed on both ends, are provided with catch projections projecting into the free space of the pockets, and the reception pockets have at least one penetration opening which extends to the rear side of the plate.

11 Claims, 11 Drawing Figures

PACKAGE FOR SEWING MACHINE NEEDLES OR THE LIKE

The invention relates to a package for sewing machine needles or the like, comprising a plate provided with needle reception pockets arranged in the form of rows adjacent to one another, the plate being made out of a flexible or elastic material.

It is known to assemble a certain number of needles into a unit in the manner such that these needles are stuck into a plate-like holding strip made of plastic with little penetration resistance. In this manner the point of the needle is protected. The predominant remaining section of the needle body however remain free. Upon removal of the needle the danger always exists of bending or other type of damage (German Gebrauchsmuster GBMs No. 1 765 379). Beyond that it is known from U.S. Pat. No. 2,817,434 to accommodate machine needles in a plate which is equipped with needle-reception pockets lying adjacent to one another in the form of rows. This plate is covered over by a clipped-on shorter cover part. The cover part has a removal flap. After swinging the flap up, the desired needle can be pulled out of the container. This construction is relatively expensive and is only intended for household packages. With the flaps improperly closed, the needles can slip out of the reception pockets.

It is an object of the invention here to provide a remedy and a package of the introductory-mentioned type for sewing machine needles, which is simple in construction and handling and makes possible an optimumly protected secure non-losable accommodation of the needles, and beyond this presents a space-saving, functionally good grouping in the case of a formation of superordinated units.

It is another object of the present invention to aid the solution of the above-mentioned object in the manner that the reception pockets (3), corresponding in their length approximately to that of the needles (1) and being closed on both ends, are provided with catch projections (R) projecting into the free space (F) of the pockets, and the reception pockets have at least one penetration opening (11) which extends to the rear side (10) of the plate.

It is still a further object of the present invention to provide advantageous further formations of the invention as set forth in the drawings and dependent claims.

As a consequence of such formations a package of increased utility is produced: Each individual needle is protected and is securely mounted in its reception pocket of the plate. The plate is closed on both ends. Removal of the needles is only possible by performing an intentional operation. This operation in any event is very simple insofar as the plate is provided with at least one penetration opening (e.g. 11) on its rear side, the opening making it possible to press-out the desired needles. Such an opening (11) extends in the shape of a slot transversely over the entire rear side of the plate into the side walls (5) of the pockets. The catch projections (R) which bring about the individual fixing of the needles are located at the level of the openings, thus in the side wall sections of the pockets, which are cut free from the bottom of the pockets. Such sections are thereby highly flexible. By an off-set or staggered arrangement of the catch projections, the machine needles can be alternatingly or reversely arranged such that bending or sagging of the relatively flat plate is avoided.

Bending could otherwise occur as a result of summing of clamping pressure. For secure fastening of the needle body in the area of its shank, the catch projections (R) are formed in the shape of substantially triangular noses or shoulders (N), the noses being formed or attached unitarily or integrally in one piece to the side walls (5) of the pockets. For facilitating the embedding of the machine needles, the noses have run-on slopes or inclined surfaces (7), the latter continuing into rearward, convexly arched, relatively steep support surfaces (8) for engagement contact with the outer surface (M) of the needle shanks (1'). In this manner a highly effective fastening is obtained. A perfect mechanical needle protection is present up to the working place (the sewing machine). The plate can be issued or handed over in the sewing operation and can be carried arround without particular protective measures. The continuous connecting surface area of the rear side of the plate can serve for placement of identification means so that confusion of the needle types can be eliminated. The corresponding information and statements concerning the contents can be associated with the goods by the use of a corresponding printed self-adhesive label or even by hot presses. Moreover the possibility exists for this smallest package unit to be designed by slipping on a sleeve or jacket as a household package. Advantageous superordinated units may be obtained with simple means in the manner that at least one of the narrow longitudinal sides (16) of the plates has catch means (17) for engagement with counter catch means (e.g. catch projection 18), the latter being provided on push-in shafts (15) of the lower part (12) of super-box (D). In this manner the plates are fixed against slipping out from such super box. Removal of the plates can take place by overcoming the catch engagement force. The recoordination of the plate in the push-in shaft is facilitated in the manner that in the end region of the narrow longitudinal sides (16) there are located run-on slopes (19), which provide a coordination-favoring pre-alignment or centering and easily overcome the counter catch means.

In an advantageous manner the lower part (12) of the upper box (D) is U-shaped. The push-in shafts (15) are formed with the counter catch means (e.g., catch projections 18) on opposite inner facing surfaces of the U-legs (14).

Precisely the springiness of the corresponding self-supporting U-legs additionally facilitates bringing about the catch engagement position. This springiness in any event is neutralized when the cap of the upper box is pushed thereon. In this manner the cap fulfills an additional function. With the next superordinated unit, in a simple manner it is obtained that several lower parts (12) of a super-box (D), respectively, each separated by nominal breaking points (S) are combined in the form of a continuous U-ledge (UL) while leaving a gap spacing (Z) relative to each other. In this manner an extra packaging is superfluous. The separation occurs simply by breaking a super-box from the connecting, remaining unit. The nominal breaking points as well as the maintainance of a certain gap spacing may be easily taken into consideration and produced by injection molding processes. The gap distance is selected in this manner such that the caps of the super-box find the necessary insertion-intermediate space.

Finally still an advantageous feature of the invention is that the edges of the narrow longitudinal sides (16) of the plate (2) are beveled and the ribs (27) which form the push-in shafts (15) therebetween are triangular in cross-section. This has the advantage of a space-conserving, indeed contacting arrangement of the plates (2) in the super-box (D).

With the above and other objects and advantages in view, the present invention will become more clearly understood in connection with the detailed description of a preferred embodiment, when considered with the accompanying drawings, of which:

Figure 1:
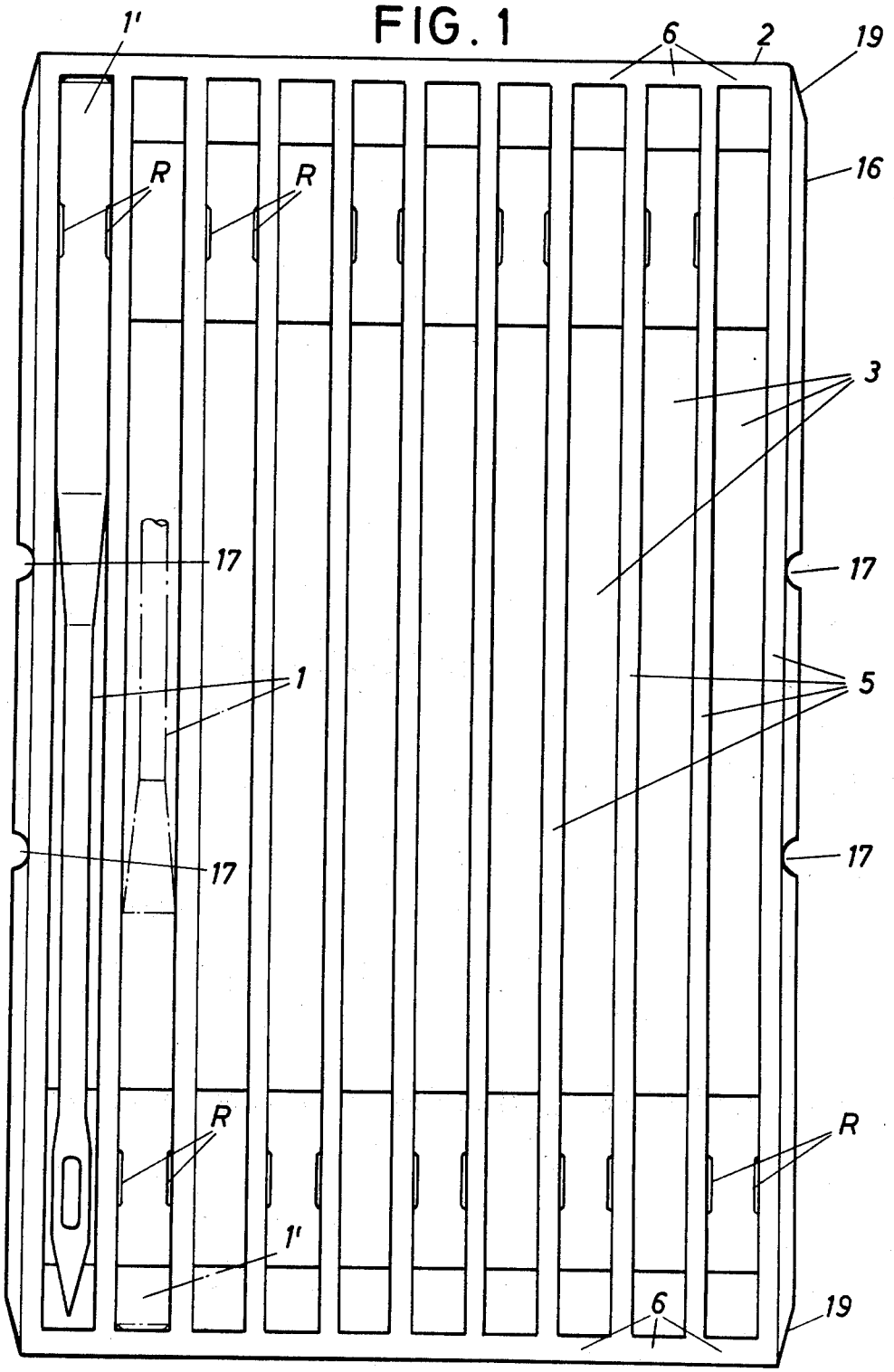
FIG. 1 is a front view of a plate in accordance with the invention, which receives needles, in considerably enlarged scale.

Referring now to the drawings, the package receiving the smallest unity of sewing machine needles 1 is formed from a plate 2. This plate has needle—reception pockets 3 which lie adjacent to one another in row-form. The pockets all are open at the front side 4 of the plate.

The side walls 5 (which bound and define the needle—reception pockets 3 lengthwise) at both ends form front or face walls 6, the latter extending with the same height as that of the pocket side walls 5. The front walls 6 close the ends of pockets 3. The reception pockets 3 are formed of such depths that the needles, even in an area of their largest cross-section, that is the shanks 1', are completely inserted, sunk inside the pockets (cf. FIG. 2) or immersed.

The length of the reception pockets is chosen somewhat larger than the length of the needles 1.

Figure 5:
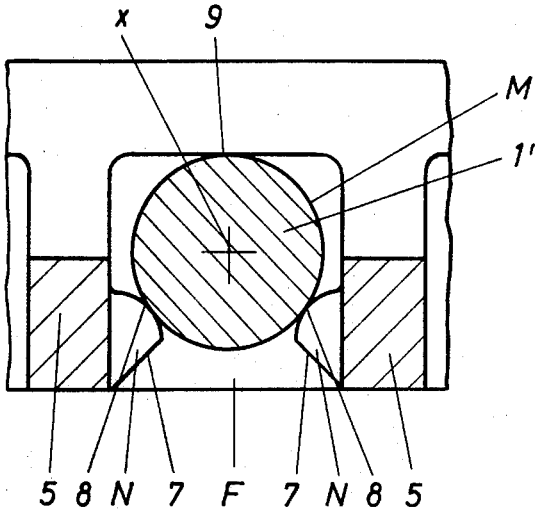
FIG. 5 is a broken-away section through a needle pocket, illustrating the catch projections which fix or secure the machine needles, and indeed in still a further enlarged scale compared to FIG. 2.

The needles 1 are individually fixed in the plate 2. Its reception pockets 3 are provided with catch projections which R project into the interior, free space F of the pockets. The catch projections are seated at the same height on the side walls 5 of the pockets, and indeed such that the catch projections R of adjacent reception pockets 3 are arranged off-set or staggered with respect to one another. With an orderly depositing of the needles, this insures an alternately, reversed alignment of adjacent needles 1. The catch projections R are attached or formed on the side walls 5 of the pockets as approximately triangularly shaped noses or shoulders N. The noses originate and extend directly from the front side 4 of the plate, and indeed each forms a run-on ramp or slope 7, the latter facilitating the depositing. The run-on ramps converge toward the interior of the pockets at an angle of 45°, in order to pass or transfer following thereon connectingly each in a rearward, convexly curved support surface 8. The latter forms the abutment for the outer or jacket surface M of the needle shanks 1' (cf. FIG. 5). The engagement of the needles on the triangularly-shaped noses N occurs on the opening side of the pocket relative to the needle axis X, so that with a cylindrical shank 1', together with the support surface 9 on the bottom side of the pocket, a three-point support exists.

Figure 3:
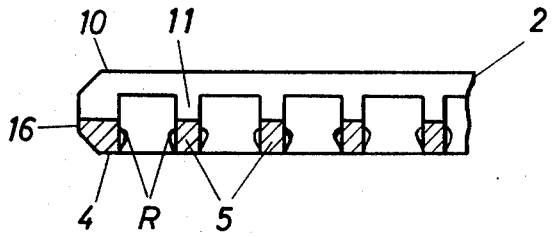
FIG. 3 is a section taken along the line III—III of FIG. 2.
Figure 4:
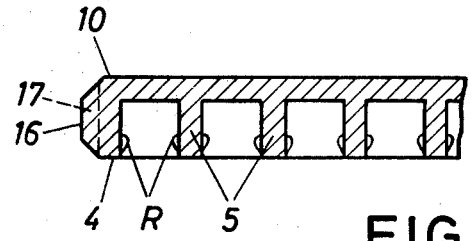
FIG. 4 is a section taken along the line IV—IV of FIG. 2.

The individual removal of the needles (which are deposited in the pockets in a protected condition), takes place by pressing them out away from the rear side 10 of the plate 2. For this purpose in the area of each of the needle shanks 1', respectively, the rear side 10 of the plate 2 forms a slot, the latter leading to openings 11 and extending transversely over the entire rear side 10 of the plate. The slot is so deep that it leaves approximately half the cross-section of the needle shank 1' exposed. Thus it extends into the side walls 5 (compare FIGS. 3 or 5). The cross-sections of the slots are trapezoidal; the wider or longer base is on the rear side 10 of the plate.

Figure 2:
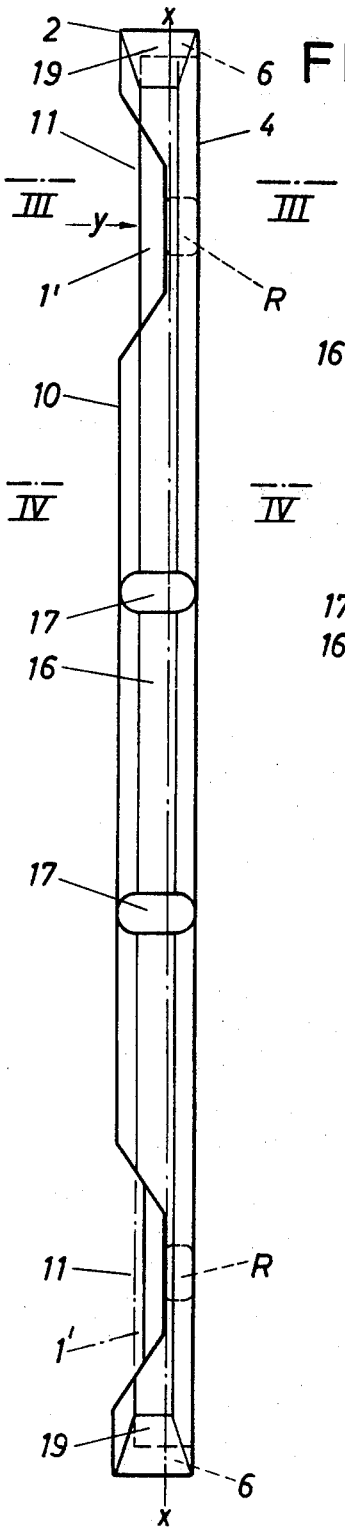
FIG. 2 is a side view of FIG. 1.

The catch projections R are located at the level of these openings 11 (cf. FIG. 2). Since the latter and the reception pockets 3 penetrate or extend into each other, in this area still only a cross-sectionally reduced, cut-free bridge-like partial section of the pocket side walls 5 remains. These pocket sections are extremely flexible, so that the catch projections R which fix the needles can project quite deeply into the free space F of the pockets. Since as a result of the reversed or alternate-sided laying of the needles, the adjacent pockets do not form any obstacle blocking the springing-out of the needles, nevertheless the needles may be pressed out by application of a force in the direction of the arrow y as indicated in FIG. 2.

The plate which is manufactured of a yieldable or flexible material, such as polystyrene, accepts ten needles.

A larger number of plates may be accommodated in one super-box or container D. The super-box D is made of a lower part 12 and a cap 13 which catching or engaging over the lower part 12.

The lower part 12 is U-shaped. Its U-legs 14, which are of the same size, in their inner surfaces form push-in insertion shafts or channels 15 for the plates 2, which plates can be coordinated therein in a standing upright position.

In order to secure the inserted plates 2 from falling out, at least one of the narrow longitudinal sides 16 of the plate 2 is provided with a catch means, here in the form of a catch recess 17. The catch recesses 17 cooperate with counter catch means in the form of projections 18 on the wall of the push-in shaft 15 of the lower part 12 of the super-box. In order to facilitate reinsertion or recoordination of the plate 2, run-on ramps 19 are formed in the end areas of the narrow longitudinal sides 16 of the plate 2. The ramps 19 spread the legs 14 somewhat apart from one another, the legs being provided with the counter catch means 18. When the catch means and the counter catch means step into complementary or congruent alignment, the restoring force of the material causes the catch projection 18 to spring or snap into the corresponding catch recess 17 of the plate 2, so that the plate 2 is secured or prevented from slipping out of the push-in shafts 15. A tilting of the plates 2 which stand on the bottom 21 in the interior of the super container is prevented by means of the push-in shafts.

After pushing the cap 13 on the lower part 12 of the super box, the legs 14 are supported from the outside. The cap 13 itself is supported with its front edge on lateral projections 20 of the bottom 21 of the lower part 12. A level-off-set support is attained by the upper edge 22' of an outwardly projecting table-shaped wall-reinforcement 22 of the legs 14. The side walls 23 of the cap 13 there have a complementary shape corresponding to a portal-like section. The consequently free, unobstructed surface can serve for application of writing with statements of the contents and/or information. The cap 13 is made of a transparent material so that the container contents can be viewed. For securing the cap 13, a clamping profile 24 is formed on the vertical front edge surfaces of the U-legs 14. The catch means are provided in both end ranges of the plate 2 so that the plates can be inserted in either position with one or their other ends.

Figure 6:
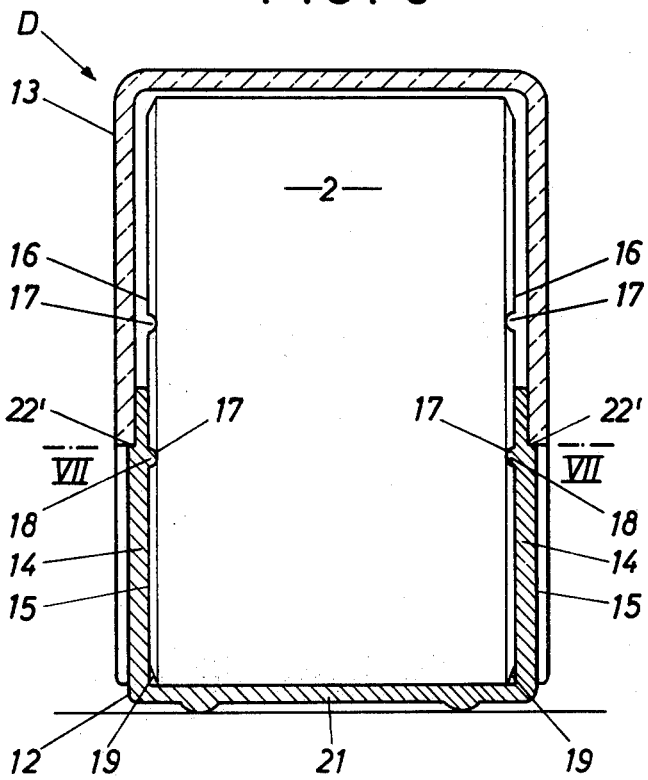
FIG. 6 is a vertical section through a super-box which receives such plates, illustrating the catch and counter catch means for securing the plates.
Figure 9:
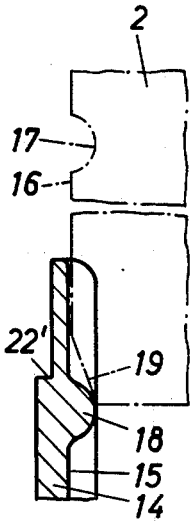
FIG. 9 is a broken away enlargement of the plate, illustrating the catch- and counter catch means, showing the plate not yet in the snap-catch engagement position.
Figure 7:
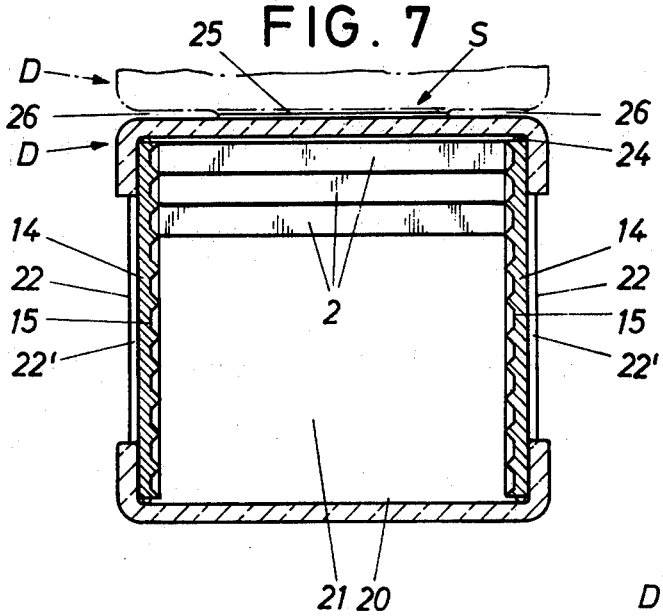
FIG. 7 is a section taken along the line VII—VII of FIG. 6 with illustration of the push-in shafts of the plates.
Figure 8:
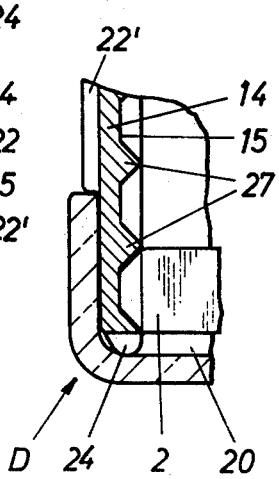
FIG. 8 is a broken away enlarged a section of the super-box, which section has the push-in shafts.
Figure 10:
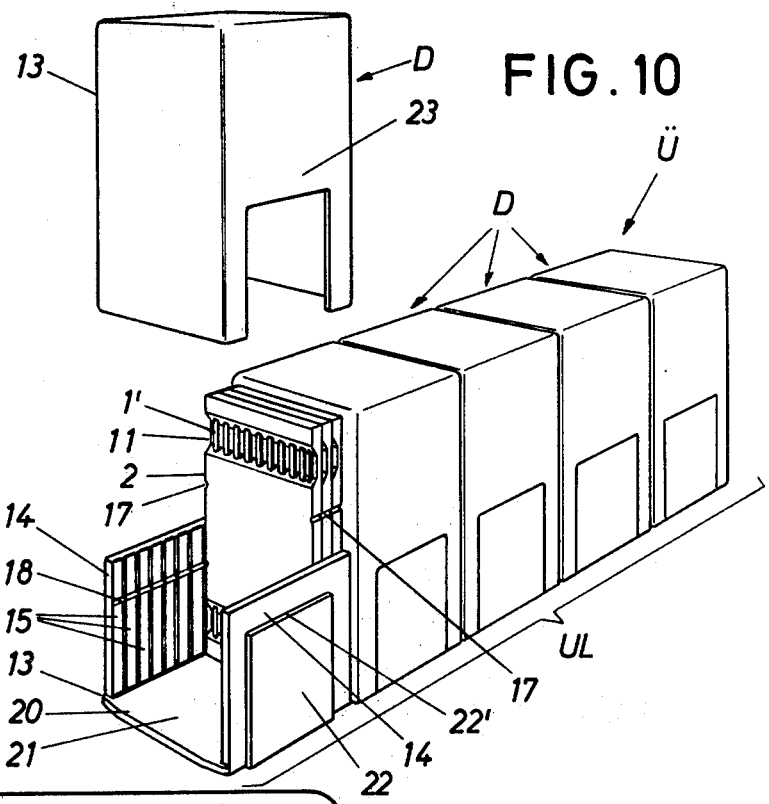
FIG. 10 is a perspective partially exploded view showing a super-unit formed from continuously connected super-boxes.
Figure 11:
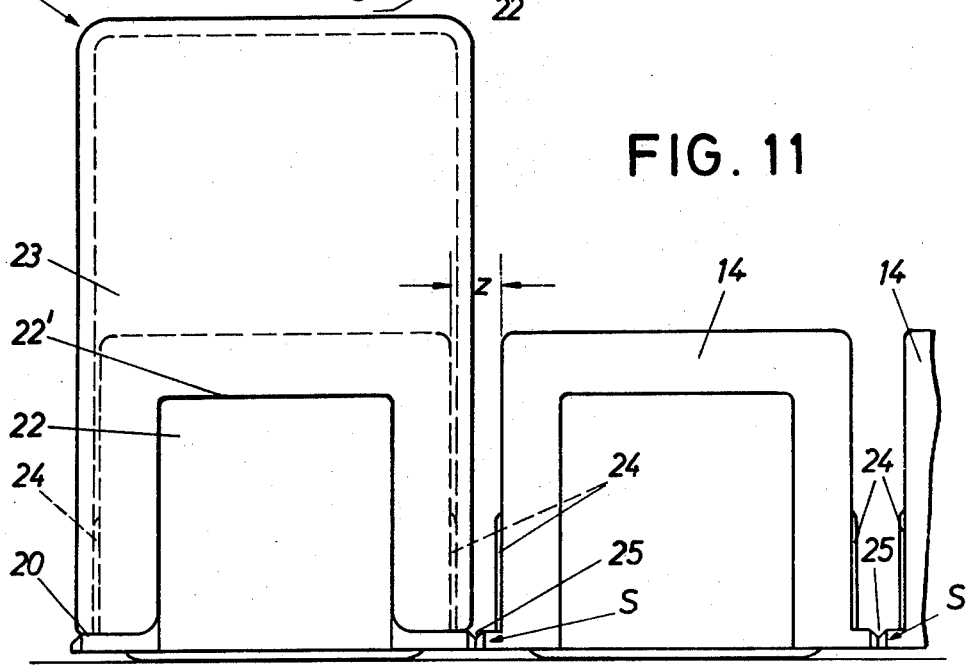
FIG. 11 is a broken away side view of this super-unit illustrating the nominal breaking points for the separation.

The overall box U according to FIG. 10 is made of five individual boxes. These boxes are assembled, each able to be separated by means of nominal breaking points S in the form of a continuous extending U-ledge UL, leaving a gap spacing Z relative to each other. The continuously extending bottom of the U-ledge is formed with notches 25 which form the nominal breaking points on the upper side as well as on the narrow sides. In order to further reduce the bridge of material, also relatively deep cuts 26 are provided from the sides. The gap distance Z is sized such that each of the caps 13 of the super-box can be assembled or coordinated and pulled-off, respectively. The additional formation of the lower parts correspond to the previously described lower part according to FIGS. 6 to 8.

The detaching or separation of the box is easily attained by bending. For this, groups of four, three or two boxes can be formed for resale.

In the manner that the edges of the narrow longitudinal sides 16 of the plates z are beveled or inclined, forming plate ribs having a substantially trapezoidal shaped cross-section (FIG. 8) and the ribs 27 (which form the push-in shafts 15 therebetween) are formed triangularly-shaped in cross-section, thus materialwise the space which was cut away is refilled, such plates 2 can be aligned in touching engagement.

While I have disclosed one embodiment of the invention it is to be understood that this embodiment is given by example only and not in a limiting sense.

I claim:

1. A package for sewing machine needles or the like, comprising a plate forming needle reception pockets in row-form adjacent to one another, said plate has a front side in which said needle reception pockets open along their length and a rear side, said plate being made out of a flexible material, said reception pockets corresponding in their lengths approximately to that of the needles, said plate having end walls closing both ends of said reception pockets and being formed with catch projections projecting into the free spaces of said pockets, and said plate being formed with at least one opening which communicates with said reception pockets and extends to the rear side of said plate.

2. The package as set forth in claim 1, wherein said catch projections of adjacent of said reception pockets are arranged staggered relative to one another, respectively.

3. The package as set forth in claim 1, wherein said plate is formed with a plurality of side walls defining said needle reception pockets, said at least one opening extends into said side walls.

4. The package as set forth in claim 2, wherein said catch projections form substantially triangular noses having run-on slopes, said noses being formed integrally on said side walls, said catch projections have rear convexly arched support surfaces adapted to contact the outer surface of a needle shank.

5. The package as set forth in claim 1, wherein said catch projections are located substantially at the level of said at least one opening.

6. The package as set forth in claim 1, wherein said plate has narrow longitudinal sides, a box having a lower part formed with a plurality of push-in shafts complementary to said longitudinal sides of said plate, said lower part has a counter catch means adjacent said push-in shafts, at least one of said narrow longitudinal sides is formed with catch means for engagement of said counter catch means.

7. The package as set forth in claim 6, wherein said counter catch means is a projection.

8. The package as set forth in claim 6, wherein said narrow longitudinal sides of said plate are bevelled at the ends thereof converging toward said ends, respectively.

9. The package as set forth in claim 6, wherein said lower part of said box is U-shaped forming U-legs and said push-in shafts are provided with said counter catch means on opposite facing inner surfaces of said U-legs.

10. The package as set forth in claim 1, further comprising a box having a plurality of lower parts, respectively, defining a continuous U-ledge forming portions connecting said lower parts spaced apart from each other and defining separatable nominal breaking points.

11. The package as set forth in claim 1, wherein said plate has narrow longitudinal sides formed with bevelled edges, a box having a lower part formed with triangular cross-sectionally shaped ribs defining a plurality of push-in shafts therebetween, said longitudinal sides with said bevelled edges are trapezoidally shaped complementary to the cross-sections of said push-in shafts, respectively.

* * * * *

REEXAMINATION CERTIFICATE (227th)

United States Patent [19] [11] B1 4,186,073

Paganoni [45] Certificate Issued Jul. 24, 1984

[54] PACKAGE FOR SEWING MACHINE NEEDLES OR THE LIKE

[75] Inventor: Cesare Paganoni, Vaals, Netherlands

[73] Assignee: Nederlandse Naaldenfabriek Muva B.V., Vaals, Netherlands

Reexamination Request:
No. 90/000,368, Apr. 29, 1983

Reexamination Certificate for:

| | |
|---|---|
| Patent No.: | **4,186,073** |
| Issued: | **Jan. 29, 1980** |
| Appl. No.: | **955,459** |
| Filed: | **Oct. 27, 1978** |

[30] Foreign Application Priority Data

Mar. 23, 1978 [DE] Fed. Rep. of Germany ... 7808823[U]

[51] Int. Cl.[3] ..... B65D 85/24
[52] U.S. Cl. ..... 206/380; 220/23.4
[58] Field of Search ..... 220/23.4; 206/214, 337, 206/380, 443, 477, 480, 454–456, 445, 387

[56] References Cited

U.S. PATENT DOCUMENTS

| | | | |
|---|---|---|---|
| 1,172,856 | 2/1916 | Williams | 206/380 |
| 1,610,110 | 12/1926 | Reiter | 211/69.8 |
| 2,017,088 | 10/1935 | Bihler | 211/70 |
| 2,817,434 | 12/1957 | Schmetz | 206/380 |
| 3,367,483 | 2/1968 | Studen | 206/17 |
| 3,384,220 | 5/1968 | Linstead | 206/380 |
| 3,385,643 | 5/1968 | Adell | 206/387 X |
| 3,452,859 | 7/1969 | Hofman | 206/380 |
| 3,647,057 | 3/1972 | Ashmead | 206/380 |
| 3,768,635 | 10/1973 | Eggert | 206/380 |
| 3,994,551 | 11/1976 | Ackeret | 206/387 X |
| 4,116,333 | 9/1978 | Pavel | 206/380 |
| 4,203,519 | 5/1980 | Fujitaki | 206/387 |

FOREIGN PATENT DOCUMENTS

| | | | |
|---|---|---|---|
| 558845 | 7/1957 | Belgium | 206/380 |
| 1703905 | 7/1955 | Fed. Rep. of Germany . | |
| 1037956 | 2/1959 | Fed. Rep. of Germany . | |
| 7133465 | 2/1971 | Fed. Rep. of Germany . | |
| 2139548 | 4/1972 | Fed. Rep. of Germany | 220/23.4 |
| 7623264 | 7/1976 | Fed. Rep. of Germany . | |
| 6613821 | 4/1968 | Netherlands | 206/455 |
| 471746 | 9/1937 | United Kingdom . | |
| 659849 | 10/1951 | United Kingdom . | |
| 1054910 | 1/1967 | United Kingdom . | |
| 1133307 | 11/1968 | United Kingdom | 206/380 |
| 1198776 | 1/1970 | United Kingdom . | |
| 1237802 | 6/1971 | United Kingdom . | |
| 1346041 | 2/1974 | United Kingdom . | |
| 1412867 | 11/1975 | United Kingdom . | |

*Primary Examiner*—George E. Lowrance

[57] ABSTRACT

A package for sewing machine needles or the like, comprising a plate provided with needle reception pockets arranged in the form of rows adjacent to one another, the plate being made out of a flexible or elastic material. The reception pockets, corresponding in their length approximately to that of the needles and being closed on both ends, are provided with catch projections projecting into the free space of the pockets, and the reception pockets have at least one penetration opening which extends to the rear side of the plate.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3, 5 and 11 are cancelled.

Claims 4, 6, and 10 are determined to be patentable as amended:

Claims 7-9, dependent on amended claims, are determined to be patentable.

New claims 12-19 are added and determined to be patentable.

4. The package as set forth in claim [2] *13*, wherein said catch projections form substantially triangular noses having run-on slopes, said noses being formed integrally on said side walls, said catch projections have rear convexly arched support surfaces adapted to contact the outer surface of a needle shank.

6. The package as set forth in claim [1] *14*, wherein said plate has narrow longitudinal sides, a box having a lower part formed with a plurality of push-in shafts complementary to said longitudinal sides of said plate, said lower part has a counter catch means adjacent said push-in shafts, at least one of said narrow longitudinal sides is formed with catch means for engagement of said counter catch means.

10. The package as set forth in claim [1] *14*, further comprising a box having a plurality of lower parts, respectively, defining a continuous U-ledge forming portions connecting said lower parts spaced apart from each other and defining separatable nominal breaking points.

*12. The package as set forth in claim 17 in which said catch projections are located substantially at the level of said last-named opening.*

*13. A package for sewing machine needles or the like, comprising*

*a plate forming needle reception pockets in row-form adjacent to one another, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with catch projections projecting into the free spaces of said pockets,*

*said plate being formed with at least one opening which communicates with said reception pockets and extends to the rear side of said plate, and*

*said catch projections of adjacent of said reception pockets are arranged staggered relative to one another, respectively.*

*14. A package for sewing machine needles or the like, comprising*

*a plate forming needle reception pockets in row-form adjacent to one another, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with catch projections projecting into the free spaces of said pockets,*

*said plate being formed with at least one opening which communicates with said reception pockets and extends to the rear side of said plates, and*

*said plate is formed with a plurality of side walls defining said needle reception pockets,*

*said at least one opening extends into said side walls.*

*15. A package for sewing machine needles or the like, comprising*

*a plate forming needle reception pockets in row-form adjacent to one another, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with catch projections projecting into the free spaces of said pockets,*

*said plate being formed with at least one opening which communicates with said reception pockets and extends to the rear side of said plate, and*

*said catch projections are located substantially at the level of said at least one opening.*

*16. A package for sewing machine needles or the like, comprising*

*a plate forming needle reception pockets in row-form adjacent to one another, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with catch projections projecting into the free spaces of said pockets,*

*said plate being formed with at least one opening which communicates with said reception pockets and extends to the rear side of said plate,*

*said plate has narrow longitudinal sides formed with bevelled edges,*

*a box having a lower part formed with triangular cross-sectionally shaped ribs defining a plurality of push-in shafts therebetween, and*

*said longitudinal sides with said bevelled edges are trapezoidally shaped complementary to the cross-sections of said push-in shafts, respectively.*

*17. A package for sewing machine needles or the like, comprising*

*a plate forming needle reception pockets in row-form adjacent to one another, said needle reception pockets including free spaces and side walls, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with catch projections projecting from said side walls into the free spaces of said pockets,*

*said plate being formed with at least one opening which communicates with said reception pockets and extends to the rear side of said plate,*

*said last-named opening extending into the pocket side walls adjacent to said catch projections whereby a portion of the needle in a reception pocket is exposed through said opening, the exposed needle portions extending rearwardly into said opening and beyond the adjacent side walls to facilitate the pushing of said needles past said catch projections.*

*18. The package as set forth in claim 17 in which said last-named opening extends into said side walls a distance so that approximately one-half of the cross section of each needle stored in said pockets are exposed.*

*19. A package for sewing machine needles or the like, comprising*

*a plate forming needle reception pockets in row-form adjacent to one another, said needle reception pockets including free spaces and side walls, said plate has a front side in which said needle reception pockets open along their length and a rear side, said plate being made out of a flexible material, said reception pockets corresponding in their lengths approximately to that of the needles,*

*said plate having end walls closing both ends of said reception pockets and being formed with two catch projections projecting from said side walls into the free space of each said pocket,*

*said catch projections engaging needles disposed within said pockets and firmly holding said needles against movement,*

*said catch projections being configurated and positioned so that the catch projections associated with a pocket are fully spread when a needle is displaced outwardly,*

*said plate being formed with at least one opening which communicates with said reception pockets and extends to the rear side of said plate,*

*said last-named opening extending into the pocket side walls adjacent to said catch projections whereby a portion of the needles in the reception pockets are exposed through said opening, the exposed needle portions extending rearwardly into said opening and beyond the adjacent side walls to facilitate the pushing of said needles past said catch projections.*

* * * * *